US007892438B2

(12) United States Patent
Nielsen

(10) Patent No.: US 7,892,438 B2
(45) Date of Patent: Feb. 22, 2011

(54) METHOD AND APPARATUS FOR COLLECTING AND/OR REMOVING SLUDGE

(75) Inventor: Ian Bradley Nielsen, Kingscliff (AU)

(73) Assignee: Ultra Aquatic Technology Pty Ltd, Kingscliff, New South Wales (AU)

( * ) Notice: Subject to any disclaimer, the term of this patent is extended or adjusted under 35 U.S.C. 154(b) by 117 days.

(21) Appl. No.: 12/278,833

(22) PCT Filed: Feb. 9, 2007

(86) PCT No.: PCT/AU2007/000135

§ 371 (c)(1),
(2), (4) Date: Dec. 4, 2008

(87) PCT Pub. No.: WO2007/090240

PCT Pub. Date: Aug. 16, 2007

(65) Prior Publication Data

US 2009/0184066 A1 Jul. 23, 2009

(30) Foreign Application Priority Data

Feb. 9, 2006 (AU) ..... 2006900613

(51) Int. Cl.
*B01D 21/18* (2006.01)
*E02F 3/88* (2006.01)

(52) U.S. Cl. ..... 210/747; 210/803; 210/122; 210/170.05; 210/242.1; 210/527; 37/320

(58) Field of Classification Search ..... 210/747, 210/803, 122, 170.04, 170.05, 242.1, 523, 210/527, DIG. 9; 37/317, 320
See application file for complete search history.

(56) References Cited

U.S. PATENT DOCUMENTS

| | | | | | |
|---|---|---|---|---|---|
| 1,107,391 | A | * | 8/1914 | Welch | 210/DIG. 9 |
| 1,919,689 | A | * | 7/1933 | Elrod | 210/527 |
| 4,152,800 | A | * | 5/1979 | Nilsmar | 210/242.1 |
| 4,776,112 | A | * | 10/1988 | Urbani | 210/242.1 |
| 5,575,921 | A | | 11/1996 | Askin et al. | |
| 5,720,891 | A | * | 2/1998 | Cook et al. | 210/803 |
| 2002/0184797 | A1 | | 12/2002 | Mertel et al. | |
| 2003/0062319 | A1 | * | 4/2003 | Keller et al. | 210/170 |
| 2005/0211637 | A1 | * | 9/2005 | Sower | 210/523 |

FOREIGN PATENT DOCUMENTS

| | | | |
|---|---|---|---|
| EP | 508680 | | 10/1992 |
| JP | 08053854 | | 2/1996 |
| WO | WO 2005/028069 | * | 3/2005 |

* cited by examiner

*Primary Examiner*—Christopher Upton
(74) *Attorney, Agent, or Firm*—Shoemaker and Mattare

(57) ABSTRACT

Apparatus (10) for removing sludge from a liquid reservoir, the apparatus (10) comprising buoyant float means (12), a sludge pump (24) mounted via a support arm (17) and the apparatus (10) having an upper profile so as to allow it in use to operate beneath a membrane covering at least part of the reservoir. The support arm (17) may be oscillated to move the pump in a substantially vertical plane. The buoyancy of the float means (12) may be adjusted to vary the position of floating of the apparatus (10) in the liquid.

20 Claims, 9 Drawing Sheets

METHOD AND APPARATUS FOR COLLECTING AND/OR REMOVING SLUDGE

TECHNICAL FIELD

This invention relates to a method and apparatus for collecting and/or removing sludge or other suspended or settling solids from a liquid reservoir and in particular but not exclusively to a method an apparatus for collecting and/or removing sludge from sewerage ponds or lagoons.

BACKGROUND ART

In many situations it is either desirable or necessary to remove sludge and other similar materials from a liquid reservoir. For example, in settling ponds such as settling ponds used in piggeries, dairies, poultry farms, animal feed lots as well as in sewerage settling ponds or other ponds, there is, over a period of time, an increase in solid matter in the pond water due to building up of sludge and sediment. As a result of build up of this material, it is necessary to empty the pond at regular intervals to allow removal of the sludge or solid matter. This firstly creates an environmental problem in liquid disposal during draining of the pond. After draining of the pond, heavy machinery is then required to be used at considerable cost to remove the solid matter or sludge which has settled on the base of the pond and then spread or arrange the solid matter or sludge for drying.

In some of the above types of pond, in particular sewerage settling ponds or lagoons, a membrane cover is provided over the pond to eliminate odour and trap methane. This not only reduces the greenhouse gas emissions but also provides a source of energy as the methane gas may be used to fire gas engines to generate electricity. In these types of pond, the gas impervious membrane cover is placed over the pond and anchored and sealed around the edges of the pond so that methane gas generated in the pond is trapped and can be drawn off when required for use.

Ponds and lagoons provided with a membrane cover of this type present particular difficulties when sludge is required to be removed from the pond. The cover is required to be lifted or removed to allow machinery to access the pond however in these circumstances, the collected methane is obviously lost thereby creating greenhouse gas problems and in addition loss of an energy resource. The disadvantages of sludge removal as referred to above are also encountered.

SUMMARY OF THE INVENTION

The present invention aims to provide a method and apparatus for collecting and/or removing sludge from a liquid reservoir and in one particular aspect from a liquid pond or lagoon of the type which is covered by a membrane cover. The method and apparatus of the invention however may be used in other settling or sludge ponds or reservoirs which are uncovered. Other objects and advantages of the invention will become apparent from the following description.

Reference to "sludge" in the description and claims includes solids or other materials which are suspended in or settle in liquid in a liquid reservoir or pond.

The present invention thus provides in one aspect, apparatus for removing sludge from a liquid reservoir, said apparatus comprising buoyant float means, a sludge pump, means for adjustably suspending said pump from said float means, and wherein said apparatus has an upper profile so as to allow it in use to operate beneath a membrane covering at least part of said reservoir.

When used in covered ponds or reservoirs, the membrane cover can rest up the apparatus without being damaged when the apparatus is moved in the pond. The upper profile of the apparatus is preferably relatively smooth. In a preferred form, the float means define the upper profile of the apparatus. Preferably, the float means has a substantially smooth uppermost surface upon which the membrane cover may rest and be supported. Alternatively a relatively rigid cover, guard or shield may be provided over the float means, the cover, guard or shield having a relatively smooth uppermost surface. In a particularly preferred form, the cover, guard or shield comprises a dome-shaped upper portion having a smooth outer surface. The cover, guard or shield are suitably located over the float means. Most preferably the operational components of the apparatus are located beneath or do not project above the float means. The cover, guard or shield suitably includes a skirt depending downwardly from the upper portion thereof and surrounding the float means.

The pump may be operated to pump sludge or other materials or liquid directly from the liquid reservoir. Preferably the pump has an outlet to which an outlet duct or the like may be connected whereby sludge or other materials or liquid may be pumped to a remote location such as a location on or adjacent a bank of the liquid reservoir.

The pump suitably is an electric motor operated pump with power for the pump motor being provided by an electrical cable connected to a remote power source. The pump may comprise a centrifugal pump. The pump alternatively may comprise an hydraulically operated pump with hydraulic fluid for the pump being supplied from a remote hydraulic pump or an hydraulic pump on the apparatus.

In a preferred arrangement the pump may be supported on a main pump support arm mounted to the float means. The arm may be supported to the float means for pivotal movement about a substantially horizontal axis so that the pump may be raised or lowered in a substantially vertical plane upon pivotal movement of the arm. The pump may be mounted to the arm for pivotal movement. The axis of pivotal movement of the pump may be substantially parallel to the axis of movement of the arm. Means may be provided for selectively adjusting the pivotal position of the pump relative to the arm. The pump may be mounted on a support bracket pivotally mounted to the arm. An actuator suitably an hydraulic actuator or ram may be connected between the bracket and arm to enable selective adjustment of the attitude of the pump relative to the arm.

Any suitably means may be provided for adjusting the pivotal position of the arm about its horizontal axis relative to the float means. In one form a support brace is mounted for pivotal movement about a substantially horizontal axis to the float means and is adapted to cooperate with the main support arm. Preferably the brace is mounted to the float means at a position spaced from the position of mounting of the arm, the pivotal axis of the brace being substantially parallel to the pivotal axis of the arm. Preferably an actuator or actuators is/are provided between the brace and float means to effect pivotal movement of the brace and thus pivotal movement of the arm. The actuator or actuators suitably comprises an hydraulic actuator or actuators. Suitably the main support arm is adapted to cooperate with a free end of the support brace such that pivotal raising and lowering of the brace effects pivotal lowering and raising of the arm and thus the pump. Preferably the brace has a slide or roller at its free end with which the arm cooperates and by which the arm is supported by the brace. The arm may include a track or tracks along which the slide or roller may run and be guided. Preferably tracks are provided on opposite sides of the arm adapted for cooperation with respective slides or rollers on the brace.

The pump of course may be suspended from the float means by any other suitable arrangement such as by a cable coupled to a winch which can be operated to selectively raise or lower the pump. The winch alternatively may be connected to the main support arm to raise and lower the arm and attached pump instead of using the support brace. The winch may be electrically operated and remote operable means such as a remote wireless control means may be provided for remotely controlling the supply of current to the winch motor.

Preferably the apparatus includes a support frame to which the float means are mounted and the main support arm and brace are pivotally mounted to the support frame.

In another configuration, the brace may be eliminated and the actuator or actuators for the main support arm and are connected between the support arm and frame to effect when actuated direct pivotal movement of the arm relative to the frame.

Preferably the float means includes one or more floats mounted to the support frame. The floats may be of annular form. The floats are suitably mounted at spaced positions to the support frame, the floats preferably being longitudinally aligned along the support frame. The or each float suitably includes or comprises one or more buoyancy members. The or each buoyancy member may define a hollow chamber which may be sealed to define one or more air reservoirs. Alternatively or additionally a plurality of buoyant bodies such as foam plastics bodies may be located in the hollow chamber. The hollow chamber may be circular or rectangular in cross section and the buoyant bodies may be tubular bodies for neat receipt in the hollow chamber. In a further alternative arrangement, a buoyant foam plastics material may be injected into the hollow chamber of the buoyancy members. The buoyancy member however may comprise any form of buoyant body or bodies.

Where the float means comprise a plurality of floats, they are suitably positioned such that access may be had to at least the pump when the main support arm is in a raised attitude adjacent the floats. Preferably in the raised attitude, the pump is accessible through one of the floats and the actuators for the brace are accessible through another of the floats.

Preferably, an aforesaid cover, guard or shield is associated with and covers each float. Preferably the cover, guard or shield associated with each float is generally cylindrical. A cover, guard or shield may include an upper domed top wall and a depending skirt which may substantially encircle a float.

Preferably the support frame is provided with one or more skids to enable the apparatus to be supported on land. Preferably the skids extend below the main support arm and pump when the support arm is in its raised position. Preferably the skids comprise skids provided on opposite sides of the support frame.

Any suitable means may be provided for moving the apparatus in the liquid reservoir in which it is operating. Such means may comprise a winching system comprising a winch having a cable coupled to the apparatus to move the apparatus in the liquid reservoir. Opposite ends of the cable may be connected to the apparatus with the cable passing around a pulley at one side of the reservoir and coupled to the winch at opposite side of the reservoir. Means may be provided for automatically reversing the winch for example where the apparatus is approaching a bank of the liquid reservoir. The reversing means may cause the apparatus to traverse back and forwards over the liquid reservoir. The automatic reversing means may include means associated with the coupling cable. The automatic reversing means may include one or more limit switches which may be actuated by one or more stop means on the cable.

In a particularly preferred form, the buoyant float means may have an adjustable buoyancy to enable the floating position of the apparatus in the reservoir to be selectively adjusted. Thus the present invention in another preferred aspect provides apparatus for removing sludge from a liquid reservoir, said apparatus comprising buoyant float means, a sludge pump for pumping sludge from said reservoir, means for adjustably suspending said pump from said float means, and means for selectively varying the buoyancy of said buoyant float means whereby said apparatus may be moved in use between a first position in which said apparatus extends at least partly above the surface of liquid in said reservoir and a second position in which said apparatus is submerged below the surface of liquid in said reservoir.

The apparatus in this aspect is particularly adapted for use in a reservoir or pond which is at least partly covered by a membrane. When positioned beneath the membrane for pumping sludge from beneath the membrane, the apparatus is in the first position in which the membrane is lifted in the region of the apparatus by the buoyancy of the apparatus above the surface of the liquid. When however the buoyancy of the float means is reduced so as to move the apparatus to the second position, the apparatus may be moved in the liquid reservoir beneath the membrane to another location in the reservoir without fouling on the membrane. When in the other location, the buoyancy of the float means may be increased to move the apparatus to its first position for pumping sludge from the reservoir.

Preferably, the upper portion of the apparatus is formed such that in use it does not damage the membrane when moving to and when in its first position. Preferably the upper portion of the apparatus has a substantially smooth domed surface. The smooth domed surface may be defined by the float means or may be defined by a cover or shield over the float means.

Preferably the float means includes one or more air or gas chambers and means are provided for selectively supplying air or gas to the or each chamber or releasing air or gas from the or each chamber to vary the buoyancy of the float means. The float means may additionally include one or more buoyant body having a fixed buoyancy.

The present invention in a further aspect provides a method for removing sludge from a liquid reservoir of the type which is at least partially covered with a membrane, said method including the steps of locating sludge removal apparatus in said reservoir beneath said membrane, said apparatus comprising buoyant float means, a sludge pump for pumping sludge from said reservoir and means for suspending said pump from said float means, and operating said pump to pump sludge in said reservoir from beneath said membrane.

Preferably the buoyancy of the float means is selectively variable and the method includes the step of selectively varying the buoyancy of the buoyant float means to move the apparatus to a first position in which said apparatus extends at least partly above the surface of liquid in the reservoir, the pump being operated when the apparatus is in the first position.

Preferably the method further includes the step of selectively varying the buoyancy of the float means to submerge the apparatus below the surface of liquid in said liquid reservoir, and moving the apparatus to a different location in said reservoir when in its second position.

When in the first position as referred to above, the pump may be moved in a substantially vertical plane during its operation to pump sludge from the reservoir from different levels in the reservoir. For this purpose, the pump is adjustably suspended from the float means.

The present invention in another preferred aspect provides apparatus for removing sludge from a liquid reservoir, said apparatus comprising buoyant float means, a sludge pump for pumping sludge from said reservoir, a pump support arm adjustably supporting said pump to said float means for pivotal movement about a substantially horizontal pivot axis, and means for oscillating said pump support arm to move said pump in said reservoir about said pivot axis.

Preferably one or more actuators are provided to effect oscillating movement of the sludge support arm about the pivot axis. The actuator or actuators suitably comprise an hydraulic actuator or actuators.

The present invention in yet another preferred aspect provides a method for removing sludge from a liquid reservoir, said method comprising the steps of providing sludge removal apparatus, said apparatus including buoyant float means, a sludge pump for pumping sludge from said reservoir, and a pump support arm adjustably supporting said pump to said float means for pivotal movement about a substantially horizontal pivot axis, and causing said pump support arm to oscillate about said pivot axis and operating said pump to cause said pump to pump sludge from said reservoir from different levels in said reservoir during oscillating movement of said pump support arm.

BRIEF DESCRIPTION OF THE DRAWINGS

In order that the invention may be more readily understood and put into practical effect, reference will now be made to the accompanying drawings which illustrate preferred embodiments of the invention and wherein:—

DETAILED DESCRIPTION OF THE PREFERRED EMBODIMENT

Figure 1:
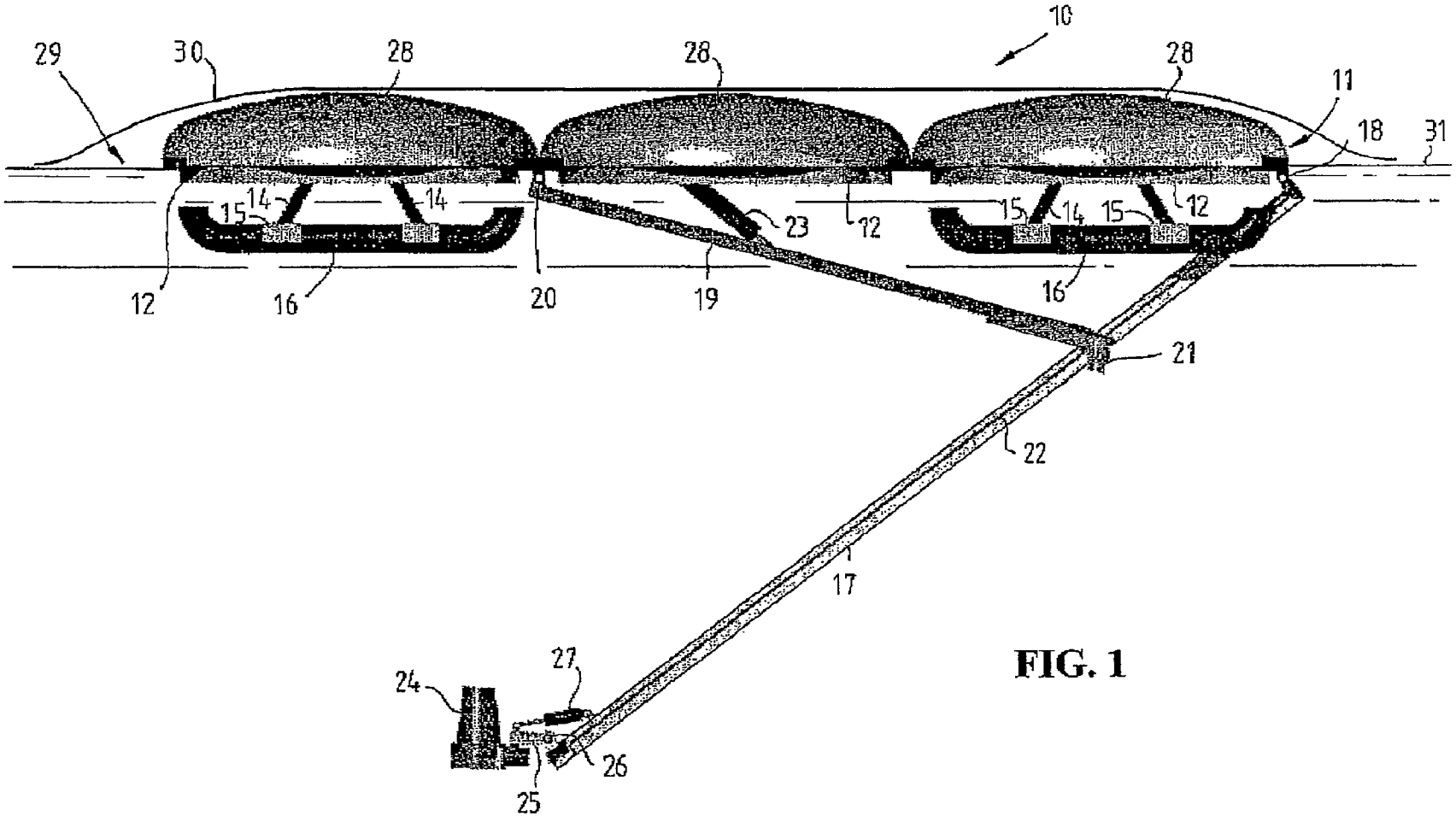
FIG. 1 illustrates in a side elevation, a sludge harvester according to a first embodiment of the invention in an operational position floating in a covered liquid reservoir.

Referring to the drawings and firstly to FIGS. 1 to 5, there is illustrated a sludge harvester 10 according to an embodiment of the invention for removing sludge or other material settling or suspended in a liquid reservoir such as an effluent pond or other settling pond. The sludge harvester 10 includes a float assembly 11 which includes in this embodiment three annular float members 12. The float members 12 may be hollow and comprise air reservoirs or alternatively may comprise or contain one or more buoyant bodies such as foam plastics members.

The float members 12 are mounted to a frame assembly 13 which includes at opposite ends downwardly depending legs 14 mounted via brackets 15 to two pairs of spaced apart elongated skids 16 on opposite sides of the frame assembly 13, the skids 16 being curved upwardly at their opposite ends. The skids 16 typically are tubular members formed of plastics. The skids 16 permit the harvester 10 to be supported on land for example on a bank at the side of a liquid reservoir or removed easily from a liquid reservoir by sliding up a bank thereof.

A pump support arm 17 is pivotally mounted at one end at 18 to one end of the support frame 13 for pivotal movement about a substantially horizontal axis, the arm 17 in this embodiment being of a channel cross section. A support brace 19 for the arm is pivotally mounted to the frame 13 at 20 for pivotal movement about a hinge axis substantially parallel to the hinge axis of the arm 17. The support brace 19 extends towards the arm 17 and rollers 21 at the free end of the brace 19 cooperate with tracks or rails 22 defined by flanges on the opposite sides of the arm 17 to support the arm 17 to the brace 19. Hydraulic rams 23 are pivotally connected between the brace 19 and support frame 13. Extension and retraction of the rams 23 will pivot the brace 19 downwardly and upwardly and as the arm 17 is supported by the rollers 21 to the brace 19, a corresponding movement of the arm 17 in a substantially vertical plane will occur.

A sludge pump 24 is mounted to a pivot bracket 25 which is pivotally mounted at 26 to the free end of the arm 17 for movement about a substantially horizontal axis. An hydraulic ram 27 is pivotally connected between the bracket 25 and arm 17 to enable adjustment of the bracket 25 about a horizontal axis. Hydraulic fluid supply lines for the ram 27 extend along the arm 17 being located in the channel of the arm 17.

Figure 5:
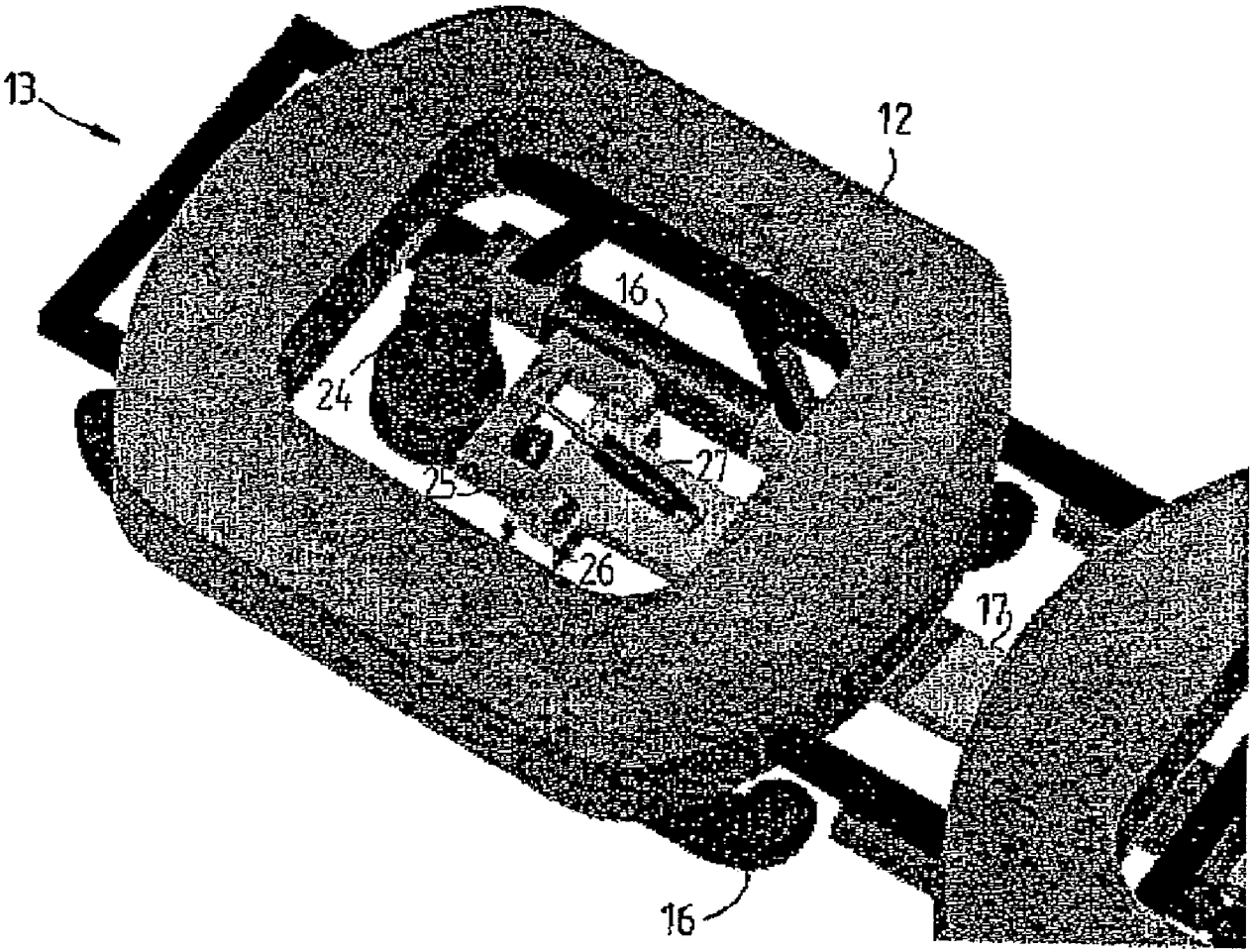
FIG. 5 is an enlarged view of an end of the sludge harvester with a float cover removed and the pump and support arm for the pump in a raised position.
Figure 8:
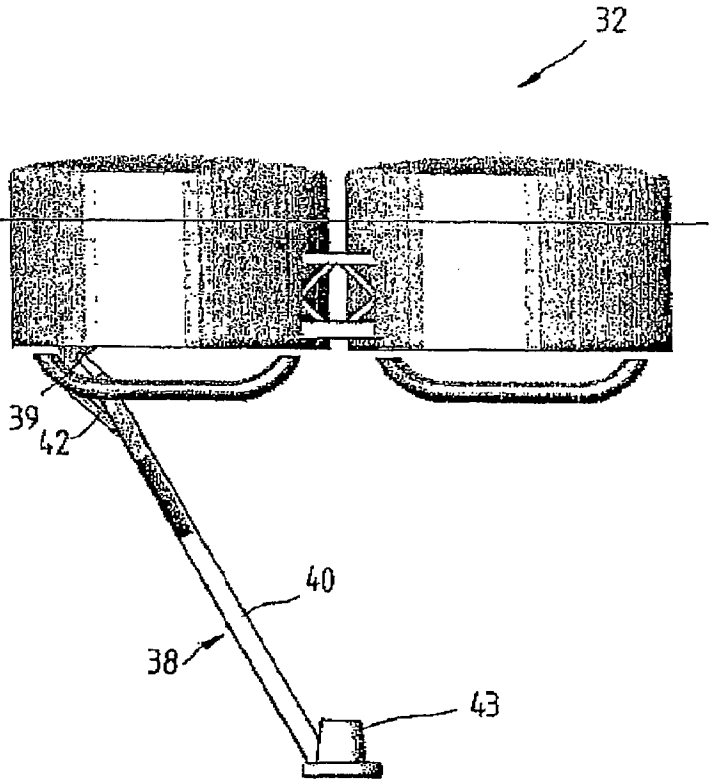
FIG. 8 illustrates the sludge harvester of FIGS. 6 and 7 with the pump in a lowered operative position.

The length of the arm 17 is such that when it is in the raised position, the pump 24, bracket 25 and ram 27 are aligned with and either are located within, or accessible through the interior open area of the end annular float 12 as is apparent in FIG. 5. In addition, the rams 23 which control the position of the brace 19 are positioned along the frame 13 so as to accessible though the interior of the central annular float 12. This allows easy access to the rams 23, and 27 and pump 24 for maintenance or service.

Figure 2:
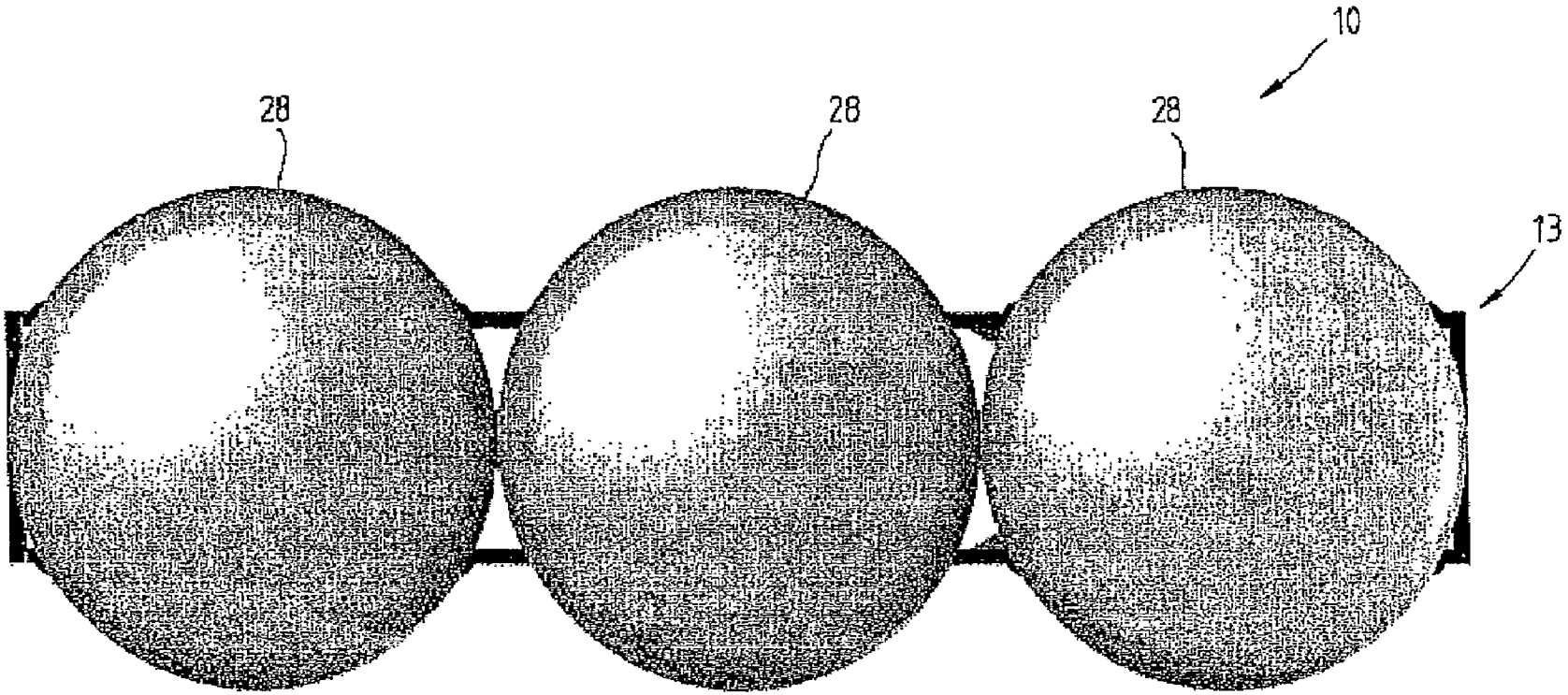
FIGS. 2 and 3 illustrates the sludge harvester of FIG. 1 in plan and underside views.
Figure 3:
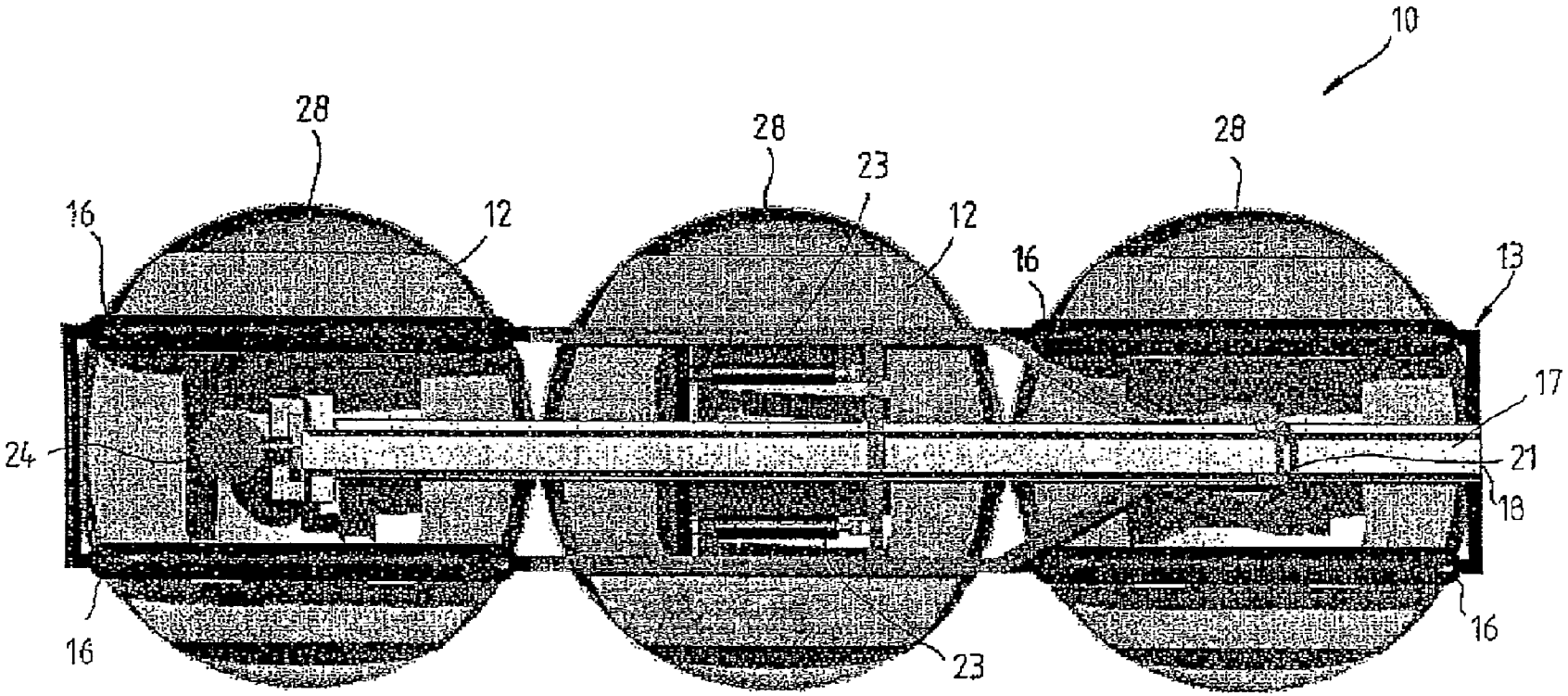

Shallow dome-shaped covers 28 are positioned over each float 12 to substantially surround and encompass the respective floats 12 and present a smooth uppermost domed surface as is apparent in FIGS. 1 and 2. The covers 28 are thus the uppermost part of sludge harvester 10 and shield all the operational components of the harvester 10. The covers 28 may be mounted to the frame 13 or to the floats 12 by any connection arrangement. The connection arrangement however is such as to allow the covers 28 to be easily removed to allow access to the floats 12 and the pump 24, and rams 27 and 23 when the arm 17 is raised. The covers 28 are typically formed of a relatively rigid plastics material.

The sludge harvester 10 is particularly suited to use with sludge ponds 29 of the type which have a gas impervious membrane 30 (see FIG. 1) which is normally supported on the surface 31 of the liquid within the pond 29 to trap methane. The apparatus 10 will float in the liquid adjacent the liquid surface 31 such that the only portion of the harvester 10 which extends above the surface 31 are the float covers 28. The smooth uninterrupted surface of the float covers 28 and the low profile thereof allow the harvester 10 to be moved around the pond 29 beneath the gas impervious membrane 30 which will rest on the covers 28. The membrane 30 will thus not be damaged and methane gas will remain trapped beneath the membrane 30. At the same time the pump 24 may be operated to pump sludge from the pond 29. Flexible discharge pipes (not shown) are connected to the pump 24 and extend to the land to enable the sludge to be pumped from the pond. 29. When in the pond, the lower edges of the covers 28 may be adjacent to the surface 31 of the pond liquid or submerged in the liquid.

The rams 23 may be operated to adjust the pivot position of the brace 19 and thus the pivot position of the arm 17 and thus the height of operation of the pump 24 with the attitude of the pump 24 being varied by adjustment of the ram 27. Thus sludge can be pumped from any level in the pond 29 by suitable adjustment of the brace 19. The rams 23 and 27 and pump 24 may be actuated by remote control such as a wireless remote control.

The sludge harvester 10 is most suitably used by being moved to different locations in the pond in which it is operating and for this purpose, a winch system (similar to the winching system described in our co-pending International patent application PCT/AU2006/001749) may be provided with the winch of the system being mounted on one bank of the pond 29 either fixedly mounted or mounted for movement along the bank. A winch cable from the winch is connected at one end to the harvester and passes around a pulley block on the opposite side of the pond and is connected back to the harvester 10.

In use when the winch is operated, the sludge harvester 10 with the pump 24 lowered as shown in FIG. 1 is moved across the pond 29 and the pump 24 operated to cause sludge to be pumped through the pump outlet to the outlet duct connected to the outlet. As the sludge harvester 10 approaches one end or side of the pond, operation of the winch will be reversed to cause the direction of movement of the harvester 10 to be reversed. When the harvester 10 approaches the opposite end or side of the pond 29, the direction of operation of the winch will be reversed as will the direction of movement of the harvester 10. The pump 24 may thus traverse over the pond 29 in opposite directions. The operation of the winch may be reversed by limit switches with which stops on the winch cable cooperate as described in our aforesaid International patent application.

Figure 4:
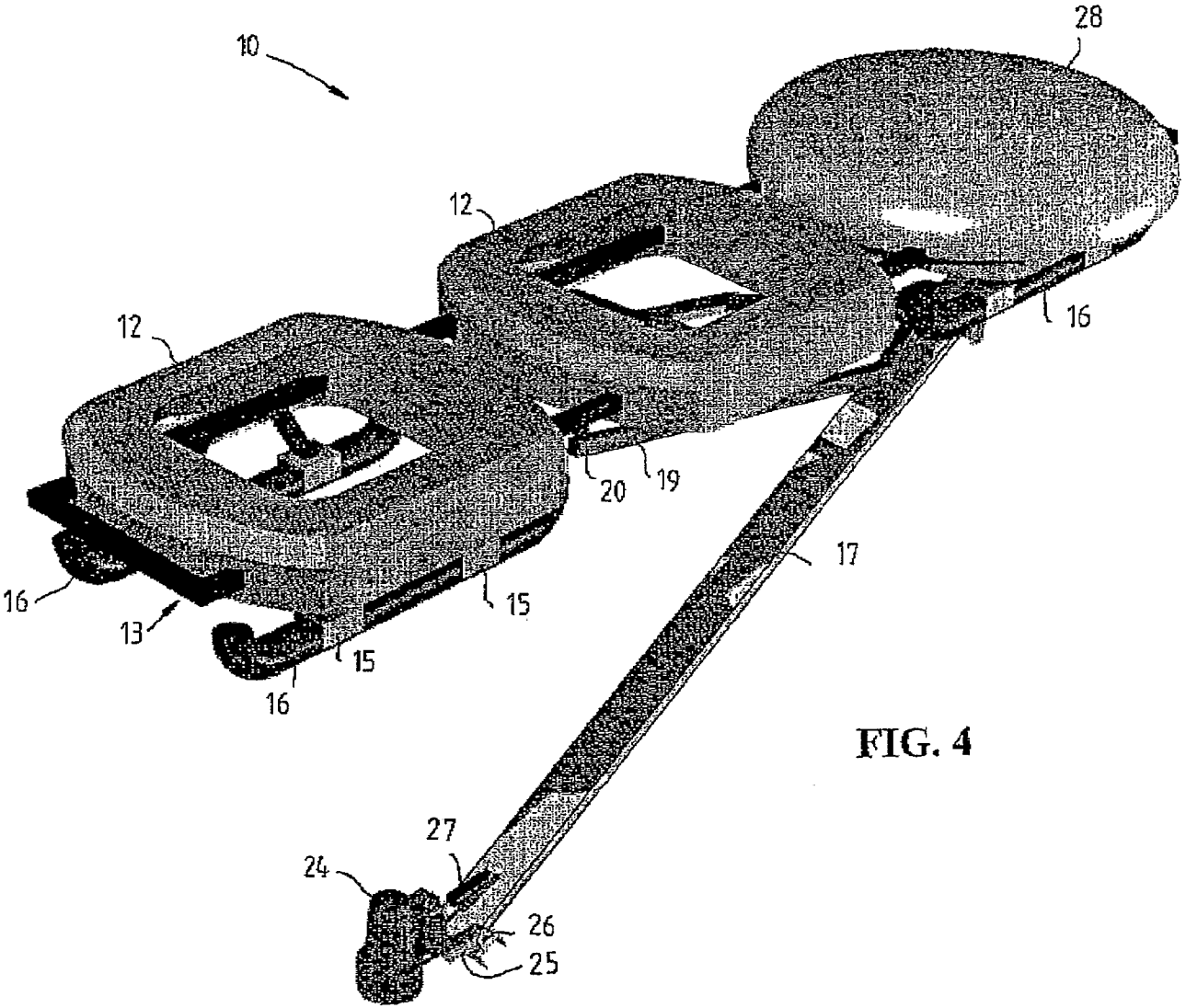
FIG. 4 is an isometric view of the sludge harvester of FIGS. 1 to 3 with two of the float covers removed.

The winch may also be moved along the bank in the opposite directions and the pulley block on the opposite bank is additionally or alternatively moved to allow other areas of the pond floor to be dredged.

Where the apparatus 10 is to be removed from the pond 29, the support brace 19 and arm 17 are raised by actuation of the rams 23 to move the arm 17 and pump 24 to the position of FIG. 4 in which the arm 17, brace 19 and pump 24 are located above the skids 16. The apparatus 10 may then be moved to the land with the skids 16 supporting the apparatus 10 for movement onto the bank of the pond 29 or the like.

If desired, submergible agitators or mixers may be mounted directly or indirectly on the arm 17 to agitate the sludge to facilitate collection by the pump 10.

The covers 28 may be formed of plastics such as polyethylene so as to define a smooth upper surface which will not damage the membrane cover 30 which is supported on the covers 28 when the apparatus 10 is within the covered pond 29. As an alternative, the floats 12 may be shaped in a similar manner to the cover 28. The covers 28 and/or floats 12 may be in many other configurations other than that described and shown in the embodiment. The covers thus may be replaced by smooth guides of any form upon which the membrane 30 may be supported and which will not damage the membrane 30 as the apparatus 10 is moved within the pond. Whilst the apparatus 10 is shown to have three floats 12, they may be replaced by a single float which may have access openings allowing access to the raised pump 24 and rams 23 and 27. In addition, the pump 24 may be supported in an alternative manner other than by means of the pivot arm 17. More than one pump may be supported to the frame assembly 13 on the arm 17 or by other means.

The frame assembly 13 may be of any form and comprise a rigid frame or separate frames associated with each float 12 with the separate frames being interconnected.

As stated above, the apparatus 10 is particularly suited to use within covered ponds but may be used in any other settling or sludge pond which is uncovered.

Referring now to FIGS. 6 to 9, there is illustrated a further embodiment of sludge harvester 32 according to the invention which is similar in configuration to the embodiment of FIGS. 1 to 5 including a float assembly 33 having in this case a pair of annular float members 34 of fixed buoyancy which may comprise sealed gas chambers or foam plastics and which are mounted at spaced positions to a main frame 35. Supported to the main frame 35 by downwardly depending legs 36 are two pairs of spaced apart elongated skids 37 on opposite sides of the main frame 35.

A pump support arm assembly 38 is pivotally mounted at spaced pivot points 39 to one end of the main frame 35 for pivotal movement about a substantially horizontal axis, the arm assembly 38 in this embodiment including an elongated arm 40 supported by a bracing frame 41 at its upper end which is pivotally mounted via the pivot points 39 to the main frame 35. Spaced apart hydraulic rams 42 are pivotally connected at opposite ends to the bracing frame 41 of the arm assembly 38 and the main frame 35 respectively. Extension and retraction of the rams 42 will thus directly pivot the arm assembly 38 downwardly and upwardly about the horizontal pivot axis defined by the pivot points 39.

A sludge pump 43 is fixedly mounted to the free end of the arm 40 of the arm assembly 38. The sludge pump 43 include an electric motor 44 which is supplied with current from cables 45 shown in dotted outline extending along the arm assembly 36. A flexible discharge pipe 46 from the pump 43 shown in dotted outline also extends along the arm assembly 38 and the pipe 46 and cables 45 are supported by floats 47 at or adjacent the surface of liquid in which the harvester 32 is operating, the cables 45 extending to a suitable power source for example on the bank of a liquid reservoir or pond and the discharge pipe 46 extending to a discharge point.

The length of the arm assembly 38 is such that when it is in the raised position, the pump 29 is aligned with and accessible through the interior open area of an annular float 34 to allow for access to the pump 43 for maintenance or service.

Positioned on the upper side of each float 34 are inflatable buoyancy bags 48, two of which are provided above each float 34 and which are located on opposite sides of the float 34. The bags 48 are secured at each end to cross arms of the main frame 35 by flexible straps 49. Air or gas lines 50 for supply of air or gas to the bags 48 are connected to the respective bags 48 and can also be supported by the floats 47 and extend to an air or gas source such as a compressor on the edge of the reservoir and connected thereto by valves which allow for individual supply of air or gas to the bags 48 or exhaust of air or gas from the bags 48. The floats 47 also support hydraulic fluid lines 51 for supply of fluid to the rams 42.

Hollow generally cylindrical covers 52 which have a domed upper wall 53 and downwardly depending skirt 53' are positioned over each float 34 such that the skirts of the covers 52 substantially surround and encompass the respective floats 34 and frame 35 and inflatable bags 48 with the domed upper wall 53 presenting a smooth uppermost surface. The covers 52 may be mounted to the frame 35 or to the floats 34 by any connection arrangement. The connection arrangement however is such as to allow the covers 52 to be easily removed to allow access to the floats 34 and components of the harvester 32 beneath the covers 51. Vents 54 are provided in the covers 52 to prevent air from being trapped beneath the covers 52 to allow the buoyancy of the harvester 32 to be varied.

When floating on a body of liquid, the buoyancy centre of gravity of the harvester 32 is always positioned above the mass centre of gravity of the harvester 32 such that no overturning moment is possible. Furthermore air or other gas may be supplied into the buoyancy bags 48 to inflate the bags or released from the bags 48 through the lines 50 to vary the buoyancy of the harvester 32 so that the level of harvester 32 in the body of liquid in which the harvester 32 is operating can be varied between a position in which the covers 52 extend partly above the surface of the liquid or a position in which the covers 52 are fully submerged beneath the surface of the liquid.

Figure 10:
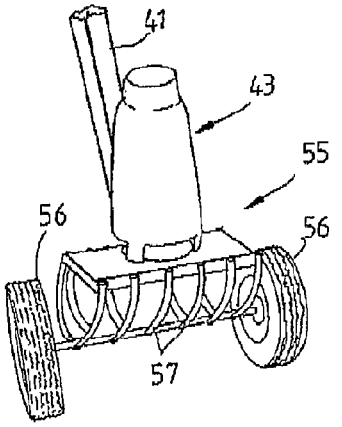
FIG. 10 illustrates an alternative pump support arrangement.

The pump 43 as shown in FIG. 10 may be mounted on a carriage 55 fixed to the lower end of the arm 41, the carriage 55 being provided with opposite tyred wheels 56 and the pump 43 opening to the underside of the carriage 55. A plurality of curved bars 57 extend between opposite sides of the carriage 55 which act as a screening grid to prevent large solids entering the pump 43. In use if the arm assembly 38 is lowered so that the carriage 55 contacts the bottom surface of a pond which may be covered in a thin membrane, the wheels 56 will prevent damage to the membrane. Further the wheels 56 will maintain the pump 43 spaced from the pond floor.

Figure 11:
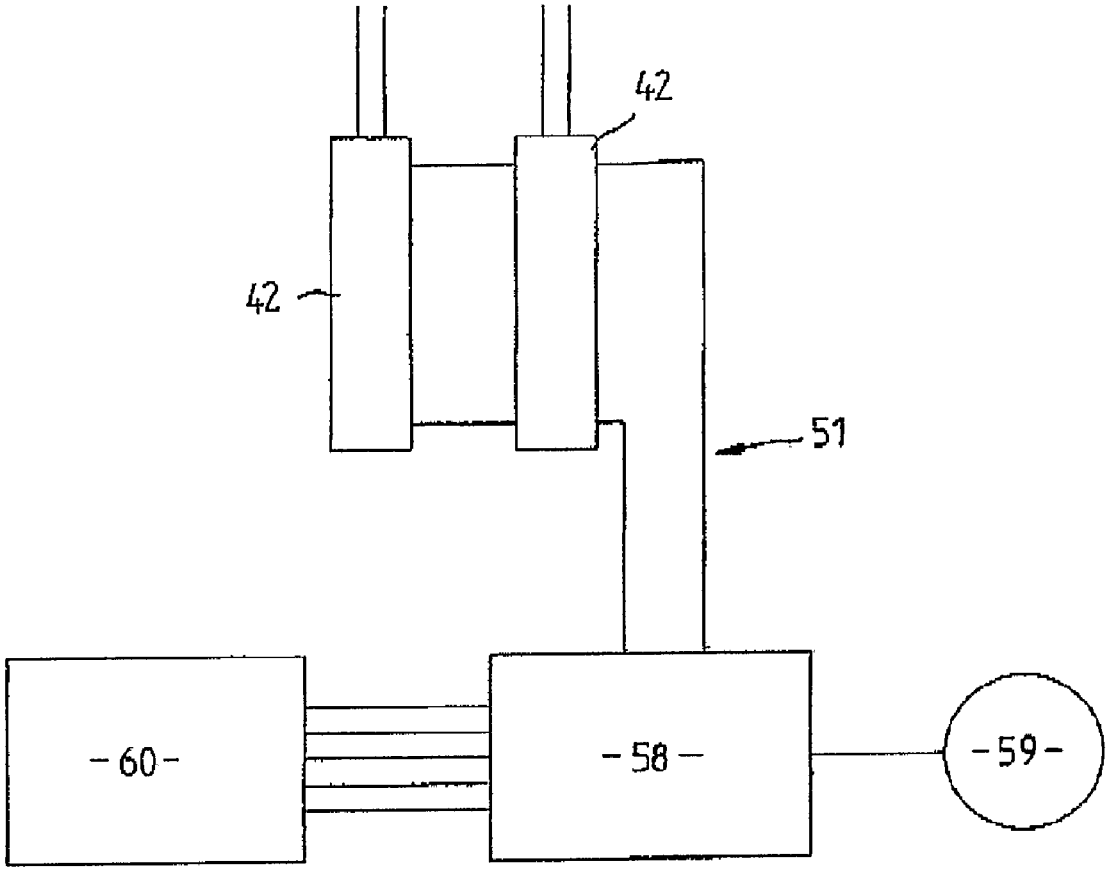
FIG. 11 is a schematic block diagram of a control circuit for control of the pump position of the harvester.

For controlling the rams 42 of the arm assembly 38, the rams 42 are connected in parallel and by control valve or valves 58 to a hydraulic fluid supply 59 (see FIG. 11) normally located at a control station on the edge of the pond in which the harvester 32 is operating. The control valve or valves 58 which is/are typically a solenoid control valve or valves is/are controlled by a controller 60 which enables the supply of hydraulic fluid to the rams 42 to be varied for example to cause reciprocation of the rams 42 or any other positioning of the rams 42. Alternatively the valves 58 may comprise manually operated valves. The control station also includes air compressors and valves to control the supply of air or gas to the inflatable bags 48 from the compressors and electrical controllers to control current supply to the pump motor 44.

Figure 12:
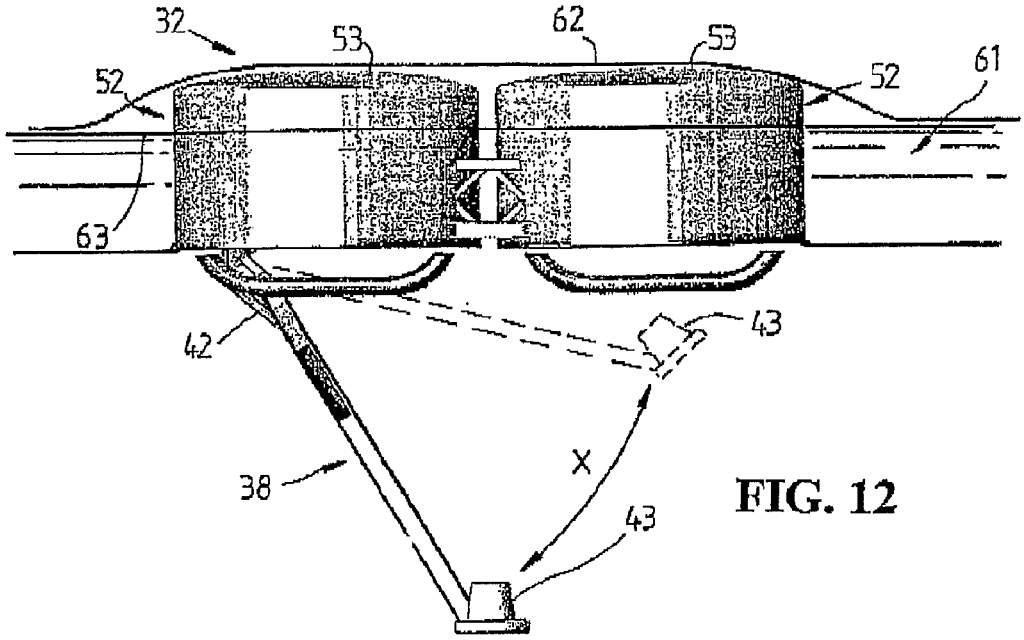
FIGS. 12 to 14 illustrate the manner in which the sludge harvester of FIGS. 6 to 9 is operated under a membrane-covered pond.
Figure 13:
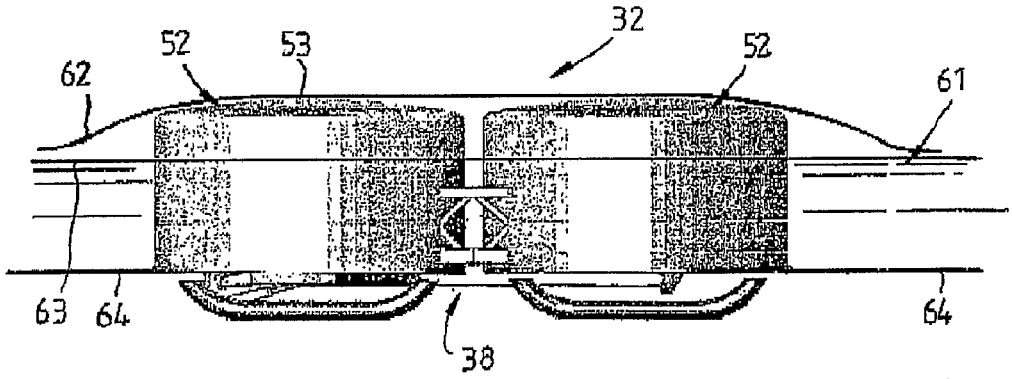
Figure 14:
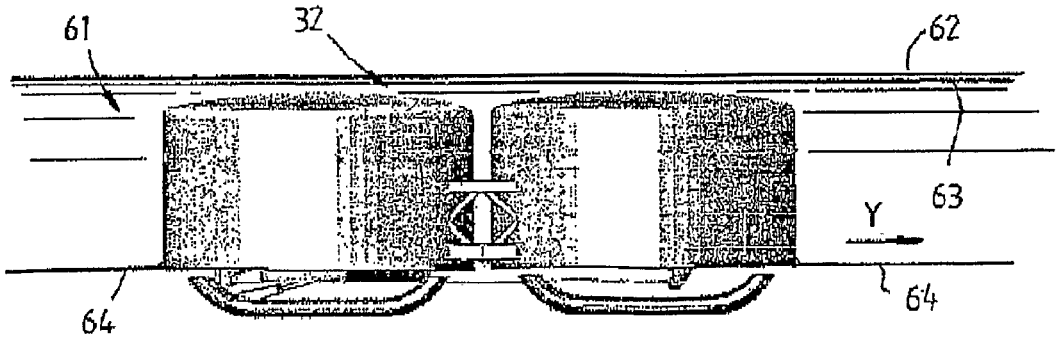

As with the embodiment of FIG. 1 and as shown in FIGS. 12 to 14, the sludge harvester 32 is particularly suited to use for removing sludge from a sludge pond 61 of the type which has a gas impervious membrane cover 62 which is normally supported on the surface of the liquid within the pond 61. In its operational position, the air or gas bags 48 are charged with air or gas to increase the buoyancy of the harvester 32 such that the float covers 52 lift above the surface 63 of the liquid as shown in FIG. 12. The float covers 52 will lift the membrane 62 a short distance above the liquid surface 63 however the smooth domed surface 53 of the cover 52 which contacts the underside of the membrane 62 will not cause damage to the membrane 62.

Figure 6:
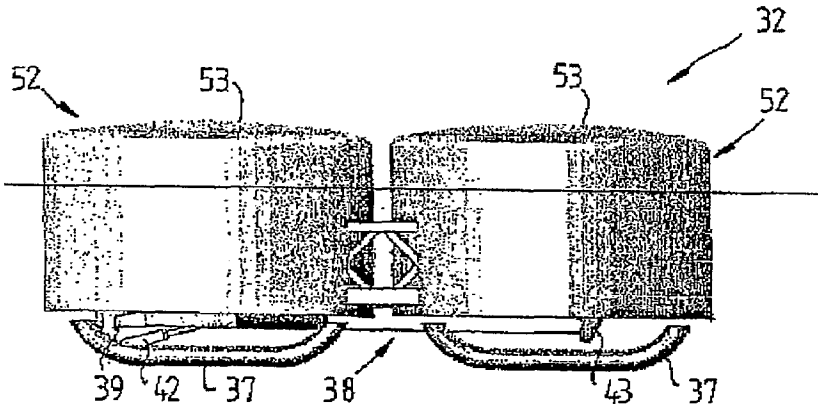
FIGS. 6 and 7 are side and plan views of a further embodiment of sludge harvester according to the invention with the pump and support arm thereof in a raised position.
Figure 7:
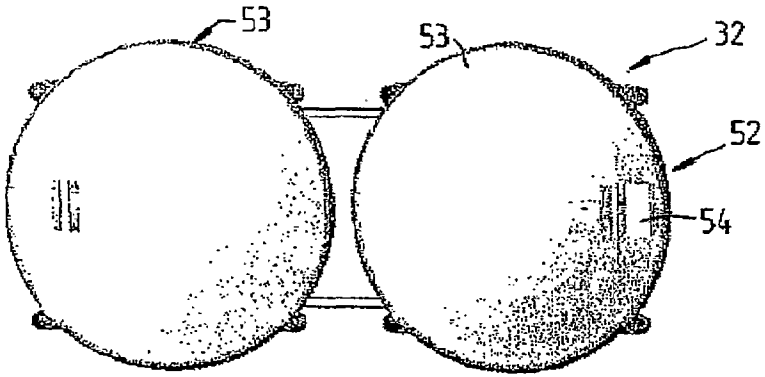

In the operational position of FIG. 12, power is supplied to the pump motor 44 to operate the pump 43 and hydraulic fluid is supplied to the rams 42 under control of the controller 60. The controller 60 causes the valves 58 to be operated automatically so as cause reciprocation of the rams 42. This will cause the arm assembly 38 to oscillate about the pivot points 39 and the pump 43 to move in a substantially vertical plane along an arc in opposite directions as indicated by the double ended arrow X in FIG. 12. Thus the pump 43 will pump sludge from the pond 61 along its arc of movement from a raised position to a lowered position. The arc of movement of the arm assembly 58 is adjusted by varying the fluid supply to the rams 42 such that the pump 43 can move through the full depth of the pond 58 if desired. The flexible sludge discharge pipe 46 connected to the pump 43 extends to the land or any other location where the sludge is to be discharged.

Where it is desired to move the harvester 32 to a different location in the pond 61, power supply is removed from the pump motor 44 and the hydraulic rams 42 are operated to move the arm assembly 38 to the position of FIGS. 6 and 13 where it lies adjacent and substantially parallel to the main frame 35. Air or gas is then released from the bags 48 to reduce the buoyancy of the harvester 32 until the upper domed surfaces 53 of the covers 52 are below the liquid surface 63 as in FIG. 14. The submerged harvester 32 can then be moved around the pond 61 beneath the gas impervious membrane 62 to a new location from which sludge is to be pumped from the pond 61. The membrane 62 will thus not be damaged and methane gas will remain trapped beneath the membrane 62.

The harvester 32 may be moved by means of a winching system located for example on the shore line (similar to the winching system of our previously referred to International patent application) with a winch cable 64 being located beneath the membrane 62 and coupled to opposite ends of the harvester 32.

When the harvester 32 in its submerged position of FIG. 14 is moved by the cable 64 for example in the direction Y to another location in the pond 61 where sludge is to be pumped from the pond 61, air or gas is re-supplied to the bags 48 to increase the buoyancy of the harvester 32 until the covers 52 rise above the liquid surface 63 and lift the membrane 62 at that position as in FIG. 13. This allows the position of the harvester 32 to be visually apparent from the shoreline of the pond. Furthermore this will provide a datum for the depth of operation of the pump 43 on the arm assembly 38. This will also provide increased stability to the harvester 32 for subsequent operation of the arm assembly 38 and pump 43 in the manner described with reference to FIG. 12.

The rams 42 may be operated in reciprocation as described with reference to FIG. 12 to oscillate the pump 43 or alternatively may be operated to adjust the pivot position of the arm assembly 38 and thus the height of operation of the pump 43 so that sludge can be pumped from any level in the pond 61.

Figure 9:
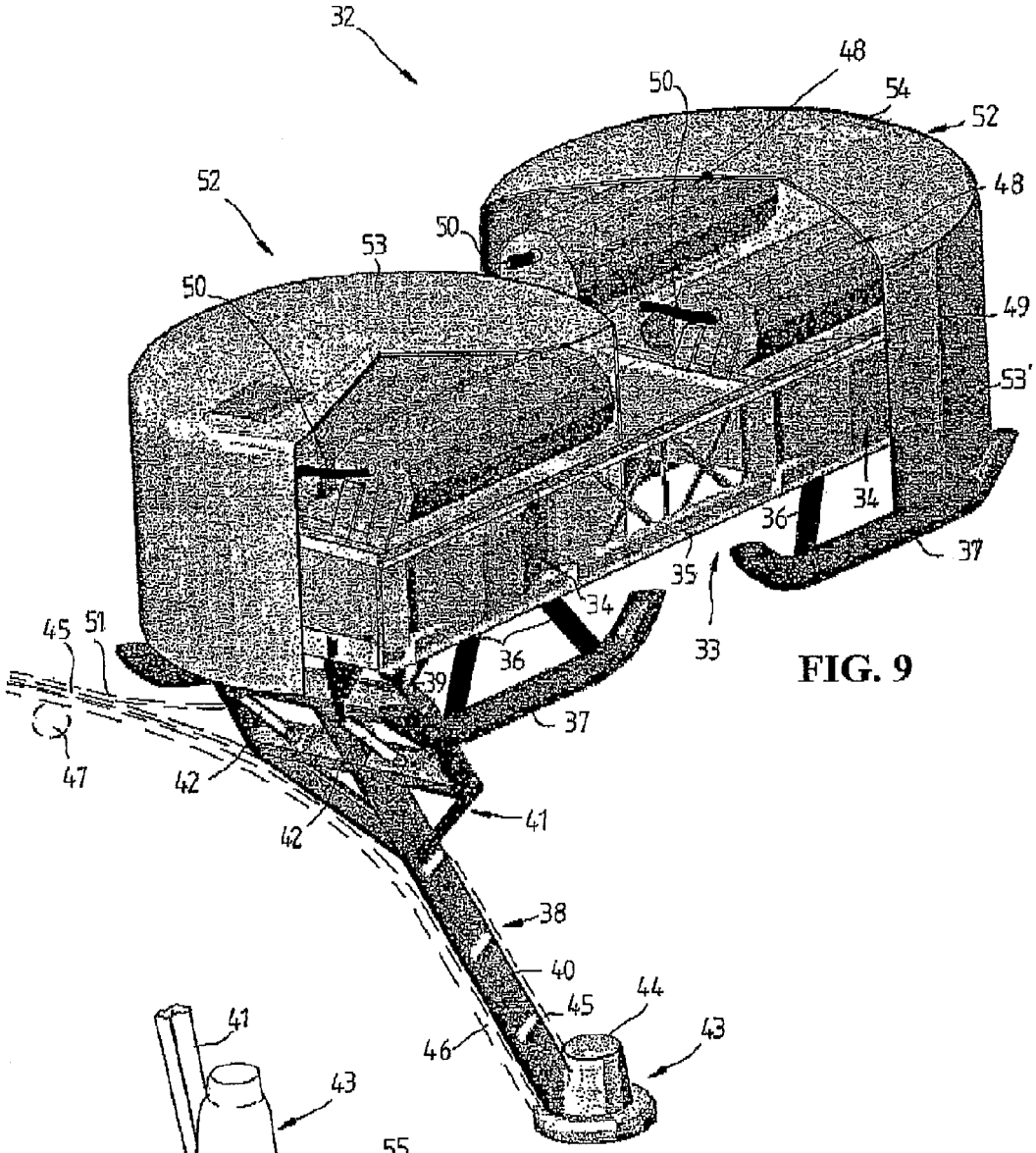
FIG. 9 is a cut away view of the sludge harvester of FIGS. 6 to 8.

Whilst the harvester 32 of FIG. 9 is described in the embodiment to have gas bags to enable the buoyancy of the harvester 32 to be selectively varied, other variable buoyancy means may be provided such as tanks or other container which may be selectively filled with liquid or filled with gas.

The harvester 10 and 32 are particularly suited for use in membrane covered pools however they may be used in non-covered pools.

The apparatus 10 of FIGS. 1 to 5 whist being described to have floats 12 of a fixed buoyancy may be provided with floats of variable buoyancy similar to the construction of the apparatus 32 of FIGS. 6 to 9 to enable it to be fully submerged for moving within a liquid reservoir.

The terms "comprising" or "comprise" or derivatives thereof as used throughout the specification and claims are taken to specify the presence of the stated features, integers and components referred to but not preclude the presence or addition of one or more other feature/s, integer/s, component/s or group thereof.

Whilst the above has been given by way of illustrative embodiment of the invention, all such variations and modifications thereto as would be apparent to persons skilled in the art are deemed to fall within the broad scope and ambit of the invention as herein defined in the appended claims.

The invention claimed is:

1. Apparatus for removing sludge from a liquid reservoir, said apparatus comprising float means, a sludge pump for pumping sludge from said reservoir, means for adjustably suspending said pump from said float means, and means for selectively varying the buoyancy of said float means whereby said apparatus may be moved in use between a first position in which said apparatus extends at least partly above the surface of liquid in said reservoir and a second position in which said apparatus is submerged below the surface of liquid in said reservoir.

2. Apparatus as claimed in claim 1 wherein said reservoir is at least partially covered with a membrane and wherein the upper portion of the apparatus is formed such that in use it does not damage the membrane when moving to or from, and when in, its first position.

3. Apparatus as claimed in claim 2 wherein the upper portion of the apparatus is of a smooth domed configuration.

4. Apparatus as claimed in claim 2 where said membrane contacts said apparatus in said first position and wherein said apparatus is submerged beneath said membrane in said second position.

5. Apparatus as claimed in claim 1 wherein said float means includes one or more air or gas chambers and there being means for supplying air or gas into the or each said chamber and for releasing air or gas from the or each said chamber to vary the buoyancy of the float means.

6. Apparatus as claimed in claim 2 wherein said float means includes a support frame, a main support arm pivotally mounted to the support frame and carrying said pump, and means for pivotally moving said main support arm in opposite directions to raise or lower said pump.

7. A method for removing sludge from a liquid reservoir of the type which is at least partially covered with a membrane, said method including the steps of locating sludge removal apparatus in said reservoir beneath said membrane, said apparatus comprising buoyant float means, a sludge pump for pumping sludge from said reservoir and means for suspending said pump from said float means, and operating said pump to pump sludge in said reservoir from beneath said membrane.

8. A method as claimed in claim 7 wherein the buoyancy of the float means is selectively variable and wherein the method includes the step of selectively varying the buoyancy of said buoyant float means to move the apparatus to a first position in which said apparatus extends at least partly above the surface of liquid in said reservoir, said pump being operated when said apparatus is in said first position.

9. A method as claimed in claim 8 wherein said method further includes the step of selectively varying the buoyancy of the float means to submerge the apparatus below the surface of liquid in said liquid reservoir, and moving the apparatus to a different location in said reservoir when in its second position.

10. A method as claimed in claim 8 wherein when said apparatus is in said first position, said method includes the step of moving said pump in a substantially vertical plane during its operation to pump sludge from the reservoir from different levels in the reservoir.

11. Apparatus for removing sludge or other suspended or settling solids from a liquid reservoir which is at least partially covered with a membrane, said apparatus comprising a float assembly, a pump mounted to said float assembly, and means for selectively adjusting the buoyancy of said float assembly, whereby said apparatus may be moved from a first operative position in which said float assembly is floating in said liquid reservoir and a second position in which said float assembly is submerged in liquid in said reservoir for movement of said apparatus to different locations in said reservoir beneath said membrane.

12. Apparatus as claimed in claim 11 and including one or more covers, guards or shields covering at least the upper parts of said float assembly, each said cover, guard or shield having a substantially smooth uppermost surface defining the upper profile of said apparatus.

13. Apparatus as claimed in claim 11 and including a main pump support arm which carries said pump, said pump support arm being mounted to said float assembly for pivotal movement about a substantially horizontal axis whereby said pump may be raised or lowered upon pivotal movement of said arm.

14. Apparatus as claimed in claim 13 wherein said pump is mounted to said support arm for adjustable pivotal movement about an axis substantially parallel to the axis of movement of the arm and including one or more actuators for selectively adjusting the pivotal position of the support arm relative to the float means.

15. Apparatus as claimed in claim 14 wherein said pump is mounted on a wheeled carriage at the free end of said support arm.

16. Apparatus as claimed in claim 13 wherein said float assembly includes a support frame, said main support arm being pivotally mounted to the support frame and said float assembly including one or more floats mounted to the support frame.

17. Apparatus as claimed in claim 16 wherein one or more of said floats comprise floats having an adjustable buoyancy.

18. Apparatus as claimed in claim 16 wherein said support frame is provided with one or more skids to enable the apparatus to be supported on land.

19. Apparatus as claimed in claim 11 wherein said float assembly includes one or more air or gas chambers and wherein said means for adjusting the buoyancy of the float assembly comprise means for selectively supplying air or gas to the or each chamber or releasing air or gas from the or each chamber.

20. Apparatus as claimed in claim 19 wherein said air or gas chambers comprise inflatable bags.

* * * * *